United States Patent [19]

Heitsch et al.

[11] Patent Number: 4,757,992

[45] Date of Patent: Jul. 19, 1988

[54] POSTERIOR SHOULDER EXERCISE MACHINE

[76] Inventors: Richard C. Heitsch, 918 NW. 104th St., Vancouver, Wash. 98685; Lewis I. Benedict, II; Dennis G. Benedict, both of 27615 NE. Rawson Rd., Brush Prairie, Wash. 98606

[21] Appl. No.: 44,754

[22] Filed: May 1, 1987

[51] Int. Cl.[4] ..... A63B 21/00

[52] U.S. Cl. ..... 272/134; 272/118

[58] Field of Search ..... 272/117, 118, 134, 143, 272/DIG. 4, 93, 130, 142

[56] References Cited

U.S. PATENT DOCUMENTS

| | | | |
|---|---|---|---|
| 3,465,592 | 9/1969 | Perrine | 272/134 X |
| 3,640,527 | 2/1972 | Proctor | 272/134 X |
| 3,912,261 | 10/1975 | Lambert, Sr. | 272/118 |
| 4,226,415 | 10/1980 | Wright | 272/DIG. 4 X |
| 4,296,924 | 10/1981 | Anzaldua et al. | 272/117 |
| 4,465,274 | 8/1984 | Davenport | 272/134 X |
| 4,478,411 | 10/1984 | Baldwin | 272/118 |
| 4,482,152 | 11/1984 | Wolff | 272/134 X |
| 4,494,751 | 1/1985 | Schnell | 272/117 |
| 4,505,475 | 3/1985 | Olschansky et al. | 272/118 |
| 4,541,628 | 9/1985 | Parviainen | 272/134 |
| 4,546,970 | 10/1985 | Mahnke | 272/118 |
| 4,635,933 | 1/1987 | Schnell | 272/134 X |

FOREIGN PATENT DOCUMENTS

| | | | |
|---|---|---|---|
| 0086913 | 8/1983 | European Pat. Off. | 272/118 |
| 2581550 | 11/1986 | France | 272/134 |

OTHER PUBLICATIONS

Advertisement for "Dyna-Cam" in *Dynamics Health Equipment Catalog*, 9-1979.

*Primary Examiner*—Richard J. Apley
*Assistant Examiner*—Robert W. Bahr
*Attorney, Agent, or Firm*—Henderson & Sturm

[57] ABSTRACT

An exercise apparatus having a base frame adapted to rest on a floor has a seat adapted to permit a person to sit thereon. An adjusting mechanism is provided for adjusting the vertical height of the seat. An upper frame is connected to the base frame and the upper frame has a pair of vertically extending shafts connected thereto and pivotally attached. A horizontally extending arm is attached to the bottom of the shafts and pads are provided for receiving the arms of individuals. A handgrip is also attached to the arms. Adjusting mechanisms are provided for selectively adjusting the vertical position of the arms with respect to the upper frame and also for adjusting the horizontal position of the arms with respect to the vertical shafts. Cams are attached to the rods and a flexible line extends from one of the cams, through a series of pulleys to some weights and back to the other cam for providing resistance to movement when the exercise apparatus is in use.

3 Claims, 1 Drawing Sheet

POSTERIOR SHOULDER EXERCISE MACHINE

TECHNICAL FIELD

The present invention relates generally to exercise machines and more particularly to a posterior shoulder exercise machine.

BACKGROUND ART

Various machines have been designed and are in commercial usage for exercising various parts of the body. Examples of such machines are shown in U.S. Pat. Nos. 3,640,527 to Proctor; 3,912,261 to Lambert; 4,296,926 to Anzaldua et al; and 4,494,751 to Schnell.

Despite the fact that there are so many exercise machines on the market, there still is a need for an exercise machine that will adequately exercise the posterior shoulder.

DISCLOSURE OF THE INVENTION

The present invention relates to an exercise machine which is designed to exercise the muscles that are not currently reached by other machines or series of designed exercises. The user sits on the machine and after adjusting the arm rest to the proper height and length, places his arms on the arm rest and grasps the handles. Grasped in full external rotation of the arms with the thumbs outward and palms upward, the machine will exercise the teres minor and infraspinatus muscles (posterior rotator cuff). Grasped in internal rotation (thumbs inward and palms down) the posterior deltoid and inferior traspezius are exercised. Having adjusted the weight to allow appropriate repetitions, the movement is outward and backward as far as possible.

The ability to strengthen the posterior shoulder muscles, particularly those of the posterior rotator cuff, significantly decreases the likelihood of shoulder injury particularly in throwing athletes such as javelin throwers and baseball pitchers. Tennis players and other athletes who stress this joint will also find this exercise machine to be useful.

The present invention is unique in that it allows the positioning necessary to exercise the muscles of the posterior shoulder. The design of the exercise arm creates a position for a seated user to accomplish this. The remainder of the machine, such as the weights, pulleys, seat and frame, serve only to put the subject in a position to use the arms and provide the necessary resistance. Exact positioning of the user's arms is crucial to reaching the posterior shoulder muscles and the present invention allows such positioning in a way that no other machine has ever done.

An object of the present invention is to provide an improved exercise apparatus.

Another object of the present invention is to provide an exercising apparatus which will adequately exercise the posterior shoulder, which needs to be strong particularly for throwing athletes such as javelin throwers and baseball pitchers.

A further object of the present invention is to provide an exercise apparatus of the aforementioned type which allows proper positioning of the user's arms and shoulders so that the proper exercise will be given to posterior shoulder muscles.

Other objects, advantages and novel features of the present invention will become apparent from the following detailed description of the invention when considered in conjunction with the accompanying drawings.

BEST MODE FOR CARRYING OUT THE INVENTION

Figure 1:
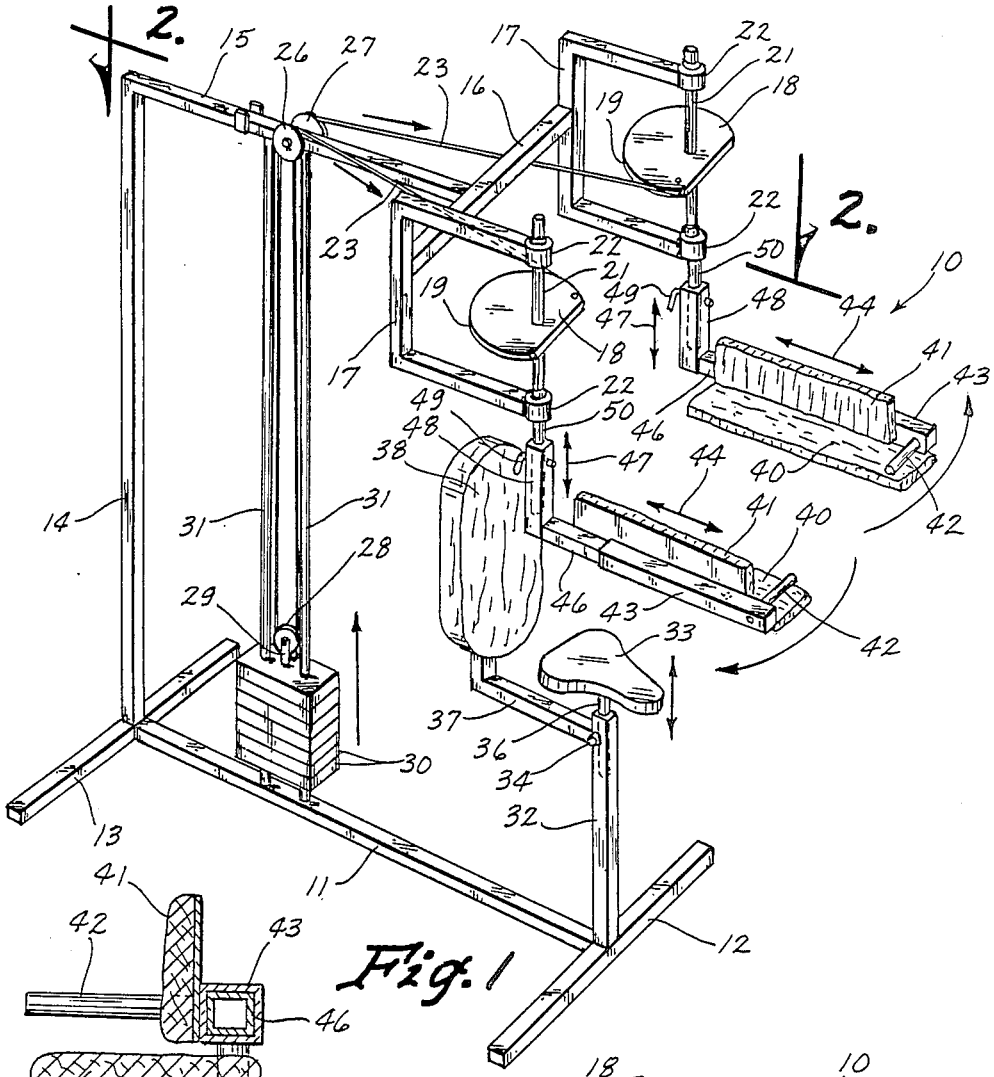
FIG. 1 is a perspective view of a preferred embodiment of the present invention.
Figure 2:
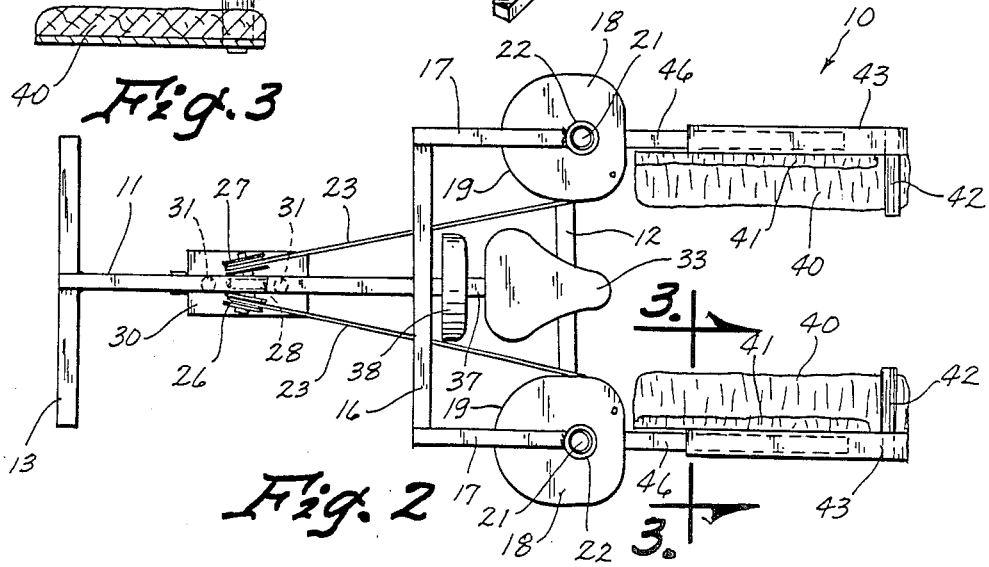
FIG. 2 is a top view taken along line 2—2 of FIG. 1.

Referring now to the drawings wherein like reference numerals designate identical or corresponding parts throughout the several views, FIG. 1 shows a preferred embodiment (10) constructed in accordance with the present invention.

The apparatus (10) includes a base frame (11) having a pair of legs (12) and (13) attached to each end thereof. A vertical post (14) connects the base frame (11) and leg (13) to an upper frame (15).

A strut (16) is rigidly connected to one end of the upper frame (15) and has a pair of U-shaped structural members (17) rigidly attached thereto. A pair of cams (18) having grooves (19) in the curved portion thereof are rigidly attached to shafts (21). These shafts (21) are pivotally or rotationally attached to the U-shaped member (17) by bearings (22) at the top and bottom thereof.

A flexible line (23), such as a cable, extends over a pair of pulleys (26) and (27), which are rotationally mounted to the upper frame (15). The flexible line (23) also extends down and over a pulley (28) rotatably attached by bracket (29) to a plurality of weights (30). These weights (30) have a pair of openings therein so that they can slide up and down on vertical rods (31).

A post (32) extends upwardly from the leg (12) and base member (11) and has a seat (33) adjustably attached to the top thereof. A pin (34), extending through openings in the post (32) and through one of the plurality of openings in shaft (36) of the seat (33), allow the height of the seat to be adjusted with respect to the post (32). An L-shaped bracket (37) positions a padded back rest (38) so that when someone is seated on the seat (33) he can rest his back against the back rest (38).

Figure 3:
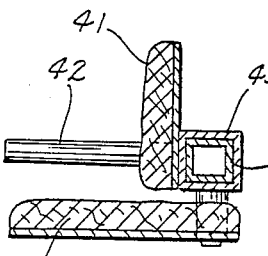
FIG. 3 is an enlarged partial cross-sectional view taken along line 3—3 of FIG. 2.

When a person is seated on the seat (33), he can place his arms on the lower padded members (40) and upper padded members (41) while grasping the handgrip rod (42). The padded members (40) and (41) and handgrip (42) are connected to a square tubular member (43), which is movable in and out along in the direction of the arrows (44) to allow the larger tube (43) to slide with respect to a smaller tube (46) as shown in FIGS. 1 and 3. This permits the apparatus to accommodate differences in body width and the imperfect circles created thereby by any person using the machine.

To adjust the position of padded members (40) and (41) and the handgrip (42) in a vertical direction, as shown by arrows (47), tubes (48) can be slideably adjusted with respect to the bottom of the shaft (21). Pins (49) can extend through openings in the sleeve (48) and through one of a plurality of openings (50) in the bottom of the shaft (21).

To use the exercise machine (10) as shown in FIG. 1, the user would first adjust the seat (33) to the desired height so that the user's feet are squarely on the floor. Then the vertical adjustment of the padded arms (40) and (41) would be made.

The user can then place his arms on the padded members (40) or (41) and grasp the grips (42). Grasped in full external rotation of the arm (thumbs outward and palms up), the machine will exercise the teres minor and infraspinatus muscles (posterior rotator cuff). This is done by pivoting the hands outwardly, thereby rotating the shafts (21) approximately 90° outwardly from the position shown in FIG. 1. When this is done, the cams (18) will turn, pulling on the cable (23) and lifting up the weights (30). The user would then slowly let the arms move back so that the pads (40) and (41) are again in the position shown in solid lines in FIG. 1. This will, of course, allow the weights (30) to move back to the position shown in solid lines in FIG. 1. If it is desired to use more or less weights (30), then one or more of such weights (30) can be added or substracted as is necessary or desired.

After the user has exercised first with the thumbs outward and the palms up, then the user can grasp the machine with the thumbs inward and the palms down for internal rotation. In this use, the posterior deltoid and inferior tapexius muscles are exercised. With the weight properly adjusted, the user will do appropriate repetitions of movement of the hands outwardly and backwardly as far as possible, which will typically be approximately 90° from the position shown in FIG. 1.

It will be appreciated that the preferred embodiment (10) does indeed accomplish the aformentioned objects. Obviously many modifications and variations of the present invention are possible in light of the above teachings. It is therefore to be understood that, within the scope of the appended claims, the invention may be practiced otherwise than as specifically described.

We claim:

1. An exercise apparatus for posterior shoulder muscle exercises comprising:

a base frame adapted to rest on a floor;

a seat adapted to permit a person to sit thereon;

means for adjustably attaching the seat to the frame;

an upper frame;

means for interconnecting the upper frame with the base frame;

a pair of vertically extending shafts pivotally connected to said upper frame, said pair of shafts being disposed upwardly and outwardly relative to said seat;

a pair of horizontally extending arms wherein each horizontally extending arm is attached to the bottom of each of said shafts;

horizontally disposed arm receiving means attached to each of said horizontally extending arms for receiving the lower arms of a person sitting on said seat; wherein, the arm receiving means comprise a horizontally disposed lower padded member and a vertically disposed upper padded member operatively attached and laterally translatable relative to the ends of each of said pair of horizontally extending arms; whereby, the users arms may be supported at the proper height necessary to exercise the posterior shoulder muscles of the user;

handgrip means attached to the arm receiving means for providing something for a person to grasp with their hands;

means for selectively adjusting the vertical position of the horizontally extending arms with respect to said upper frame;

means for permitting said arm receiving means to move in a horizontal direction with respect to said pair of horizontally extending arms;

cam means rigidly attached to said shafts;

a flexible line connected on both ends to said cam means; and resistance means operatively attached to the flexible line for pulling said horizontally extending to a first position and offering resistance to movement to a second position substantially ninety degrees from said first position.

2. The apparatus of claim 1 wherein said resistance means comprises weight means operably attached to said flexible line.

3. The apparatus of claim 1 including a first and second pulley operatively connected to said upper frame and a third pulley connected to said weight means, said flexible line extending from said first cam means, around a part of said first, second and third pulleys to said cam means.

* * * * *